US007861560B2

(12) United States Patent
Ryu et al.

(10) Patent No.: US 7,861,560 B2
(45) Date of Patent: Jan. 4, 2011

(54) DRUM TYPE WASHING MACHINE AND BALANCER FOR DRUM TYPE WASHING MACHINE

(75) Inventors: Doo Young Ryu, Suwon-si (KR); Ja Young Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 335 days.

(21) Appl. No.: 11/892,926

(22) Filed: Aug. 28, 2007

(65) Prior Publication Data

US 2008/0105003 A1 May 8, 2008

(30) Foreign Application Priority Data

Nov. 7, 2006 (KR) ..... 10-2006-0109589

(51) Int. Cl.
*D06F 27/00* (2006.01)

(52) U.S. Cl. ..... 68/13 R; 68/12.06; 68/253 C

(58) Field of Classification Search ..... None
See application file for complete search history.

(56) References Cited

U.S. PATENT DOCUMENTS 5,850,749 A * 12/1998 Kim ..... 68/23.2
6,658,902 B2 * 12/2003 Southworth et al. ..... 68/23.2
2002/0016997 A1 * 2/2002 Jonsson ..... 8/159

FOREIGN PATENT DOCUMENTS

KR 20-1996-011524 5/1996
KR 1997-62395 12/1997
KR 10-0201653 3/1999
KR 2005110071 A * 11/2005

OTHER PUBLICATIONS

Park et al. (Appears as Kim et al. above), KR 10-2005-0110071, May 2006, English machine translation.*
Gang, Gyeong-Seok, Oct. 1998, KR1998-0066063, English machine translation.*
Korean Office Action dated Mar. 31, 2010 issued in corresponding Korean Patent Application.

* cited by examiner

*Primary Examiner*—Michael Barr
*Assistant Examiner*—Jason Y Ko
(74) *Attorney, Agent, or Firm*—Staas & Halsey LLP

(57) ABSTRACT

A drum type washing machine having a balancer to prevent a reduction in the washing capacity of a rotating drum while preventing a collision noise of balls installed in the balancer. The diameter of the balls is maintained in a range of 12 millimeters to 30 millimeters, so as to prevent a collision noise of the balls during rotation of the rotating drum while preventing a reduction in the washing capacity of the rotating drum.

5 Claims, 5 Drawing Sheets

DRUM TYPE WASHING MACHINE AND BALANCER FOR DRUM TYPE WASHING MACHINE

CROSS-REFERENCE TO RELATED APPLICATIONS

This application claims the priority benefit of Korean Patent Application No. 2006-0109589, filed on Nov. 7, 2006 in the Korean Intellectual Property Office, the disclosure of which is incorporated herein by reference.

BACKGROUND

1. Field

Embodiments relate to a drum type washing machine, and, more particularly, to a drum type washing machine having a balancer to attenuate vibration generated during a washing or dehydrating (drying) cycle of laundry.

2. Description of the Related Art

In general, a drum type washing machine includes a body defining the outer appearance of the washing machine, a tub provided in the body and used to receive wash water therein, and a rotating drum rotatably provided in the tub and adapted to rotate upon receiving a rotating force from a drive motor.

In operation of the above described drum type washing machine, as the rotating drum rotates in the tub, laundry is raised and dropped repeatedly, together with wash water, along an inner peripheral surface of the rotating drum, to achieve a laundry washing operation. Specifically, the rotating drum is configured to rotate during a washing cycle or dehydrating (drying) cycle, and in particular, to rotate at a high speed during a dehydrating (drying) cycle.

The rotating drum, however, may cause an imbalanced mass, during rotation thereof, by the weight of laundry filled in the rotating drum. That is to say, the drum type washing machine has a problem of vibration caused by the imbalanced mass of laundry. To solve this problem, the drum type washing machine is provided with a balancer to attenuate vibration caused during rotation of the rotating drum. The balancer includes a plurality of balls movably installed therein, the balls acting as mass bodies.

In the drum type washing machine, generally, the rotating drum causes approximately (about) 300 grams of the imbalanced mass during rotation thereof. Accordingly, to eliminate the imbalanced mass caused during rotation of the rotating drum, the balls of the balancer should have a weight of approximately (about) 300 grams.

When excessively small-diameter balls are installed in the balancer to deal with the imbalanced mass of approximately (about) 300 grams caused in the drum type washing machine, a great number of balls should be installed. This has the risk of causing a collision noise of the balls during rotation of the rotating drum. Also, when excessively large-diameter balls are installed in the balancer to deal with the imbalanced mass of approximately (about) 300 grams caused in the drum type washing machine, the volume of the balancer disadvantageously increases in correspondence to the increased diameter of the balls, and there is the problem of a reduction in the washing capacity of the rotating drum.

SUMMARY

Embodiments have been made to solve the above problems. It is an aspect of embodiments to provide a drum type washing machine having a balancer capable of preventing a reduction in the washing capacity of a rotating drum while preventing a collision noise of balls installed in the balancer.

In accordance with an aspect of embodiments, there is provided a drum type washing machine including a body defining the outer appearance of the washing machine, a tub installed in the body, a rotating drum rotatably installed in the tub, and a balancer to compensate for an imbalanced mass caused by laundry during rotation of the rotating drum, the balancer including a housing installed to the rotating drum and a plurality of balls movably installed in the housing, wherein the diameter of the balls is more than 12 millimeters for preventing a collision noise of the balls during rotation of the rotating drum, and is less than 30 mm for preventing a reduction in the washing capacity of the rotating drum.

The balls may be made of iron.

The imbalanced mass caused by the laundry during rotation of the rotating drum may be 300 grams.

A radius of the balancer may be 280 millimeters.

When the diameter of the balls is more than 12 millimeters, the magnitude of the central angle of a sector, defined by the center of the balancer and the balls installed in the balancer, may be less than 100 degrees. Also, when the diameter of the balls is less than 30 millimeters, the magnitude of the central angle of the sector defined by the center of the balancer and the balls installed in the balancer may be more than 18.5 degrees.

In accordance with an aspect of embodiments, a drum type washing machine includes a rotating drum; and a balancer to compensate for an imbalanced mass caused by laundry during rotation of the rotating drum, the balancer including a housing installed to the rotating drum and a plurality of balls movably installed in the housing, wherein the diameter of the balls is more than 12 millimeters, and the diameter of the balls is less than 30 mm.

In accordance with an aspect of embodiments, a balancer for installation in a drum type washing machine having a rotating drum, wherein: the balancer compensates for an imbalanced mass caused by laundry during rotation of the rotating drum, the balancer includes a housing to be installed in the rotating drum and a plurality of balls movably installed in the housing, and the diameter of the balls is more than 12 millimeters, and the diameter of the balls is less than 30 mm.

BRIEF DESCRIPTION OF THE DRAWINGS

These and/or other aspects, features, and advantages of exemplary embodiments will become apparent and more readily appreciated from the following description of exemplary embodiments, taken in conjunction with the accompanying drawings, of which.

DETAILED DESCRIPTION OF EMBODIMENTS

Figure 1:
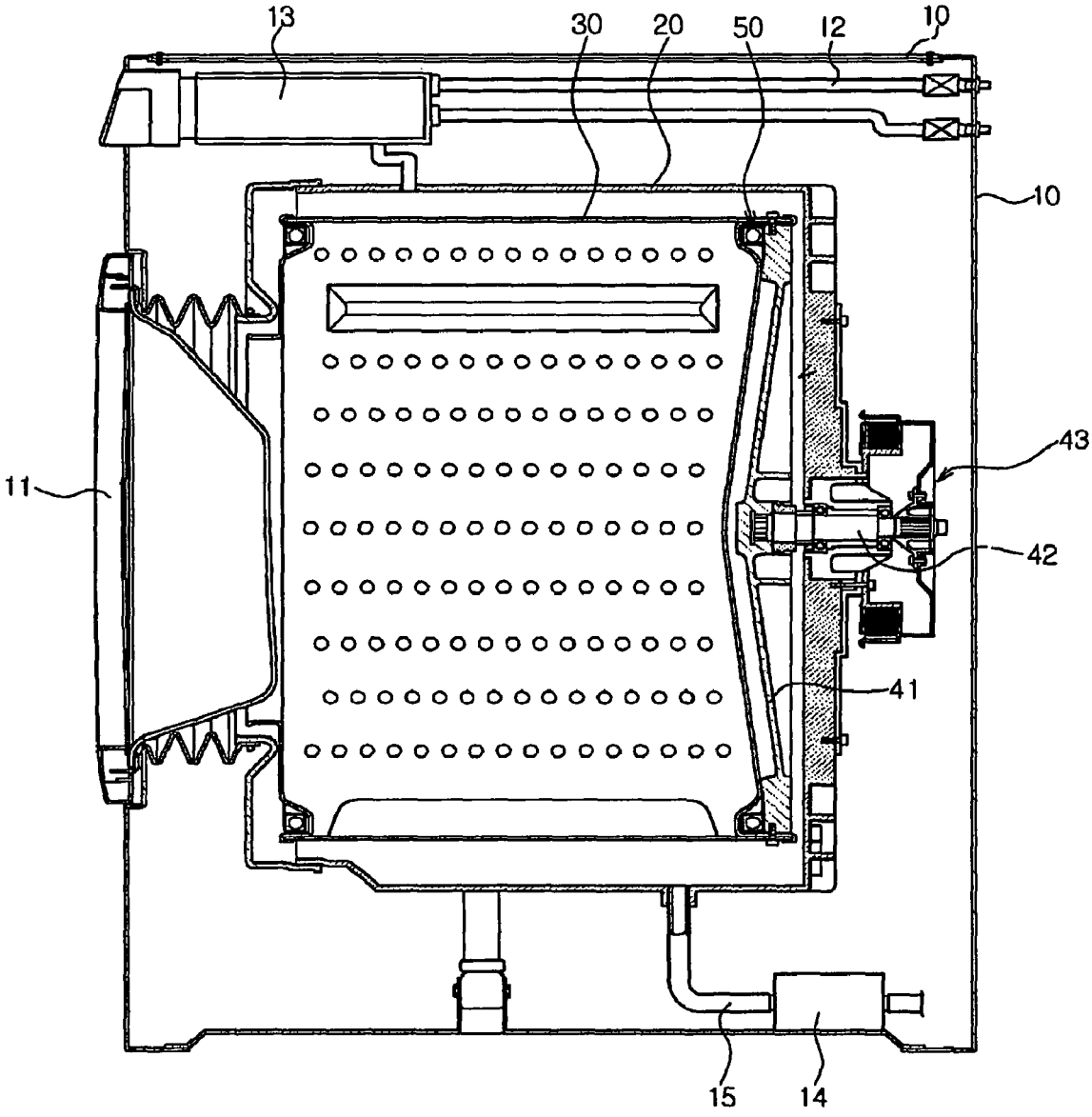
FIG. 1 is a sectional view illustrating a drum type washing machine in accordance with an exemplary embodiment.

Reference will now be made in detail to exemplary embodiments, examples of which are illustrated in the accompanying drawings, wherein like reference numerals refer to like elements throughout. The Exemplary embodiments are described below by referring to the figures.

Referring to FIG. 1, a drum type washing machine in accordance with an exemplary embodiment includes a body 10 defining the outer appearance of the washing machine, a tub 20 installed in the body 10 to receive wash water during a washing operation, and a rotating drum 30 rotatably installed in the tub 20 to accomplish a laundry washing operation. A door 11 is installed to a front surface or upper surface of the body 10, to open or close a laundry opening, through which laundry is put into or taken out from the body 10.

A water supply pipe 12 and a detergent supply unit 13 are installed in the body 10, to supply wash water and detergent into the tub 20. The detergent supply unit 13 has an interior space to receive a detergent therein, and is installed toward the front surface of the body 10 to facilitate the user's easy detergent input operation. A drainage pump 14 and a drainage pipe 15 are installed in a bottom region of the body 10, to discharge the wash water, received in the tub 20, to the outside of the body 10.

A motor 43 is mounted at an outer surface of the tub 20, to rotate the rotating drum 30 clockwise or counterclockwise. A flange shaft 41 and a rotating shaft 42 are installed to a rear outer surface of the rotating drum 30, so as to constitute a shaft system for transmitting a rotating force of the motor 43 to the rotating drum 30.

With this configuration, if the rotating shaft 42 is rotated by the motor 43, the flange shaft 41, which is coupled to the rotating shaft 42, is rotated. Thereby, as the rotating drum 30, which is connected to the flange shaft 41, is rotated, laundry received in the rotating drum 30 can be washed or dehydrated.

Figure 2:
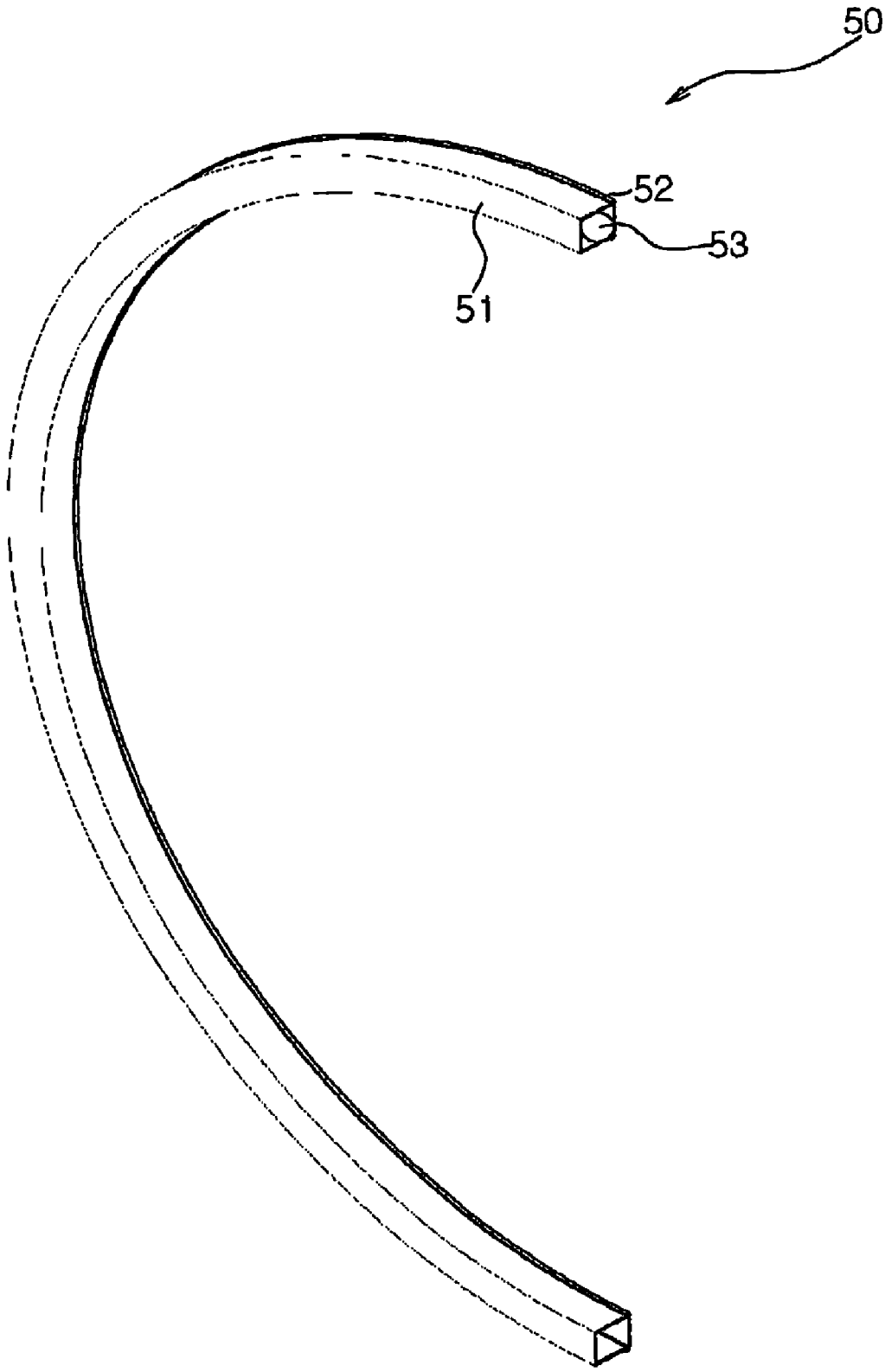
FIG. 2 is an exploded perspective view illustrating an exemplary embodiment of a balancer for a drum type washing machine in accordance with an exemplary embodiment.

As shown in FIGS. 1 and 2, the rotating drum 30 is installed with a balancer 50. As stated above, during rotation of the rotating drum 30, laundry filled in the rotating drum 30 tends to cause an imbalanced mass due to the weight thereof, and consequently, the imbalanced mass causes vibration of the rotating drum 30. The balancer 50 serves to rapidly attenuate the vibration of the rotating drum 30, thereby stabilizing the rotation of the rotating drum 30 in its early stage. In an exemplary embodiment, the balancer 50 has an annular shape, and is installed concentrically with a rotating center O of the rotating drum 30.

More specifically, the annular balancer 50 includes a balancer housing including a first balancer housing 51 and a second balancer housing 52, which are coupled to each other at front and rear positions, so as to define a race therebetween for the movement of mass bodies such as spherical balls. The balancer 50 further includes a plurality of spherical balls 53 movably installed in the race, the balls 53 acting as the mass bodies.

The above described drum type washing machine conventionally causes an imbalanced mass of approximately (about) 300 grams during rotation of the rotating drum 30. Accordingly, to compensate for the imbalanced mass, in an exemplary embodiment, the plurality of balls 53, installed in the balancer 50, preferably have a weight of approximately (about) 300 grams.

Assuming that the weight of the balls 53 is maintained at approximately (about) 300 grams and the diameter of the balls 53 exceeds a predetermined millimeter value, the volume of the balancer 50 increases. Such an increase in the volume of the balancer 50, however, results in a reduction in the washing capacity of the rotating drum 30. Therefore, it is important to select an appropriate diameter of the balls 53.

The weight of a single ball can be calculated by the following Equation 1.

the weight of a single ball=the specific gravity of the ball*the volume of the ball ($m=\rho*4/3\pi(d/2)^3$) Equation 1

On the basis of the above Equation 1, the weight of the single ball can be calculated from the diameter of the ball. In an exemplary embodiment, the diameter of the ball is preferably less than 30 mm, to prevent the washing capacity of the rotating drum from being reduced by the increased volume of the balancer.

Figure 3:
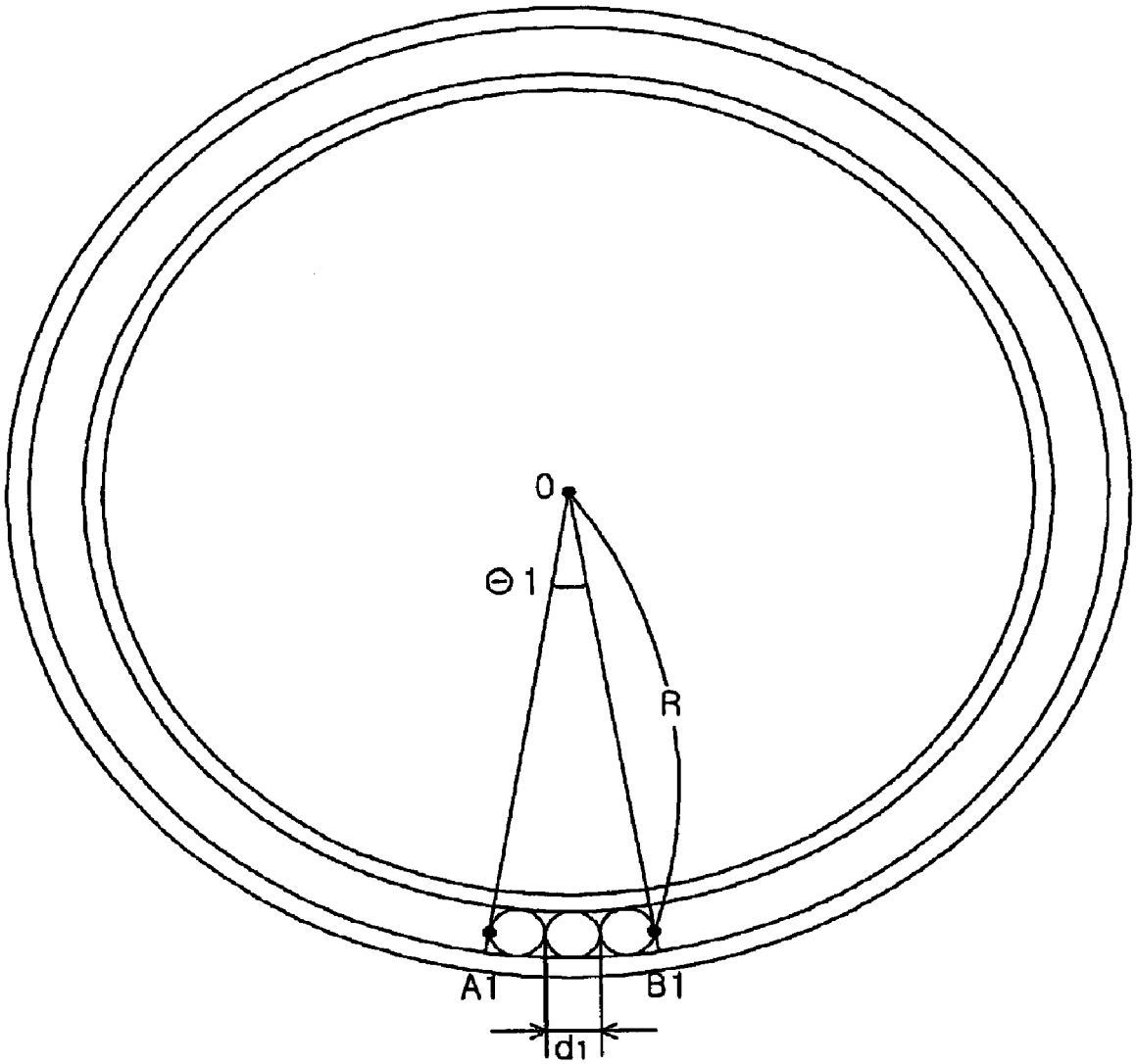
FIG. 3 is a plan view illustrating an exemplary embodiment of a balancer for a drum type washing machine in accordance with an exemplary embodiment.

In an exemplary embodiment as shown in FIG. 3 in which the diameter of a single ball is 30 millimeters, the weight of the ball can be calculated as 110 grams, and three balls can be installed in the balancer, to correspond to the imbalanced mass of 300 grams.

In an exemplary embodiment, the balls 53 are made of iron, and the radius R of the balancer 50, i.e. a distance from the center O of the balancer 50 to the ball A1 or B1 is 280 millimeters. In another exemplary embodiment, the distance from the center O of the balancer 50 to the ball A1 or B1 may be about 280 millimeters.

If the radius R of the balancer 50 has the above value and the diameter d1 of the balls 53 is 30 millimeters, the magnitude of the central angle (∠A1OB1; θ1) of a sector defined by the center O of the balancer and the balls A1 and B1 can be calculated as 18.5° on the basis of the following Equation 2.

$2\pi R:Arc=360°:\theta x$ Equation 2

Accordingly, in an exemplary embodiment, the diameter of the balls installed in the balancer is maintained less than 30 millimeters and the overall weight of the balls is maintained at approximately (about) 300 grams, in order to prevent a reduction in the washing capacity of the rotating drum due to the increased volume of the balancer.

Further, in an exemplary embodiment, the magnitude of the central angle of the sector, which is defined by the center of the balancer and the balls installed in the balancer, is adjusted within a predetermined angle, in order to prevent a collision noise of the balls installed in the balancer.

Figure 4:
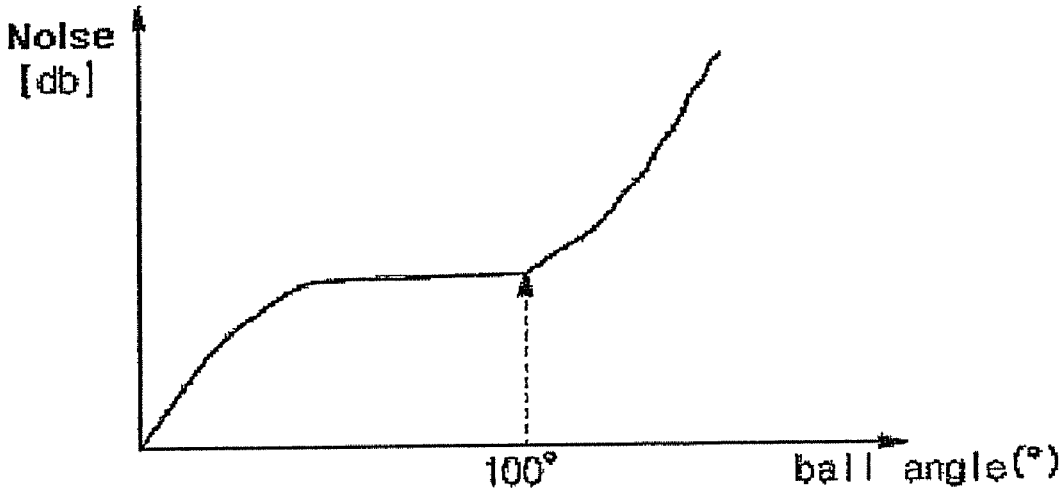
FIG. 4 is a graph illustrating a relationship of noise and a central angle of a sector defined by the center of a balancer and balls installed in the balancer.

As shown in FIG. 4, if the central angle of the sector, which is defined by the center of the balancer and the balls installed in the balancer, exceeds 100 degrees, it results in a rapid increase in noise. Therefore, the central angle (∠A2OB2; θ2) of the sector, which is defined by the center O of the balancer 50 and the balls 53 installed in the balancer 50, is preferably maintained less than 100 degrees. For this, the diameter d2 of the balls installed in the balancer 50 has to be maintained more than 12 millimeters.

Figure 5:
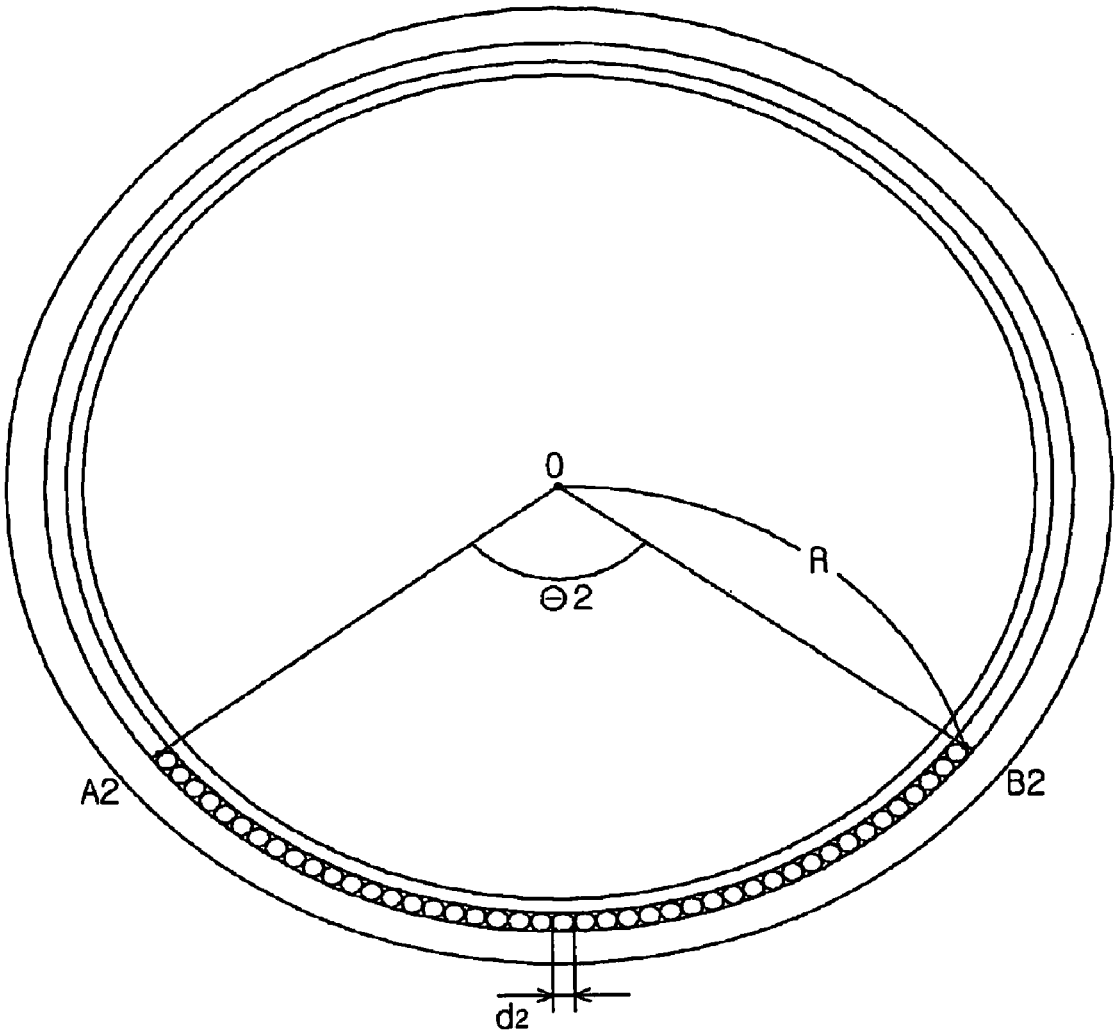
FIG. 5 is a plan view illustrating another exemplary embodiment of a balancer for a drum type washing machine.

As shown in FIG. 5, in another exemplary embodiment in which the diameter of the balls 53 installed in the balancer 50 is 12 millimeters, the weight of a single ball can be calculated as 7.8 grams on the basis of the above Equation 1. In this case, forty-three balls 53 can be installed in the balancer 50, to correspond to the imbalanced mass of 300 grams. Here, the balls 53 are made of iron, and the radius R of the balancer 50, i.e. a distance from the center O of the balancer to the ball A1 or B1 is 280 millimeters. In another exemplary embodiment, the distance from the center O of the balancer 50 to the ball A1 or B1 may be about 280 millimeters.

If the radius R of the balancer 50 has the above value and the radius d2 of the balls 53 is 12 millimeters, the magnitude of the central angle (θ2) of a sector, which is defined by the center O of the balancer and the balls A2 and B2, can be calculated as approximately (about) 100 degrees on the basis of the above Equation 2.

Accordingly, in an exemplary embodiment, the diameter of the balls 53 installed in the balancer is maintained more than 12 millimeters and the overall weight of the balls 53 is maintained at approximately (about) 300 grams, so as to prevent a collision noise of the balls 53 installed in the balancer 50.

As apparent from the above description, exemplary embodiments provide a drum type washing machine in which the diameter of balls, installed in a balancer, is maintained in a range of 12 to 30 millimeters and the overall weight of the balls is maintained at 300 grams. With the use of the balancer, exemplary embodiments have the effect of preventing not only a reduction in the washing capacity of a rotating drum, but also a collision noise of the balls during rotation of the rotating drum.

Although a few exemplary embodiments have been shown and described, it would be appreciated by those skilled in the art that changes may be made in these exemplary embodiments, the scope of which is defined in the claims and their equivalents.

What is claimed is:

1. A drum type washing machine comprising:

a cabinet body;

a water tub installed in the cabinet body;

a rotating drum installed in the water tub receiving laundry to be washed, the rotating drum including a front cover with an opening provided at a front side of a drum body to receive laundry and a rear cover provided at a rear side of the drum body; and a balancer to compensate for an imbalanced mass during rotation of the rotating drum, the balancer including a housing mounted on the rotating drum and a plurality of balls movably disposed within the housing, wherein a number of the balls (n) disposed in the housing of the balancer and the weight of each individual ball (m) disposed in the housing of the balancer are selected such that a mass imbalance of at least 300 grams is capable of being compensated by the balancer during the rotation of the rotating drum and such that the following conditions are satisfied:

$$\rho*4/3\pi(d/2)3=m,$$

$$12mm<d<30mm,$$

$$(d*n/R)*(180°/\pi)=\theta,$$

$$18.5°<\theta<100°,$$

and $$3<n<43,$$

wherein ρ is a specific gravity of the balls, d is a diameter of the balls installed in the housing of the balancer, and R is a radius of the balancer, m is the weight of a single ball, and θis a central angle of a sector defined by the center of the balancer and the balls installed in the balancer, wherein an annular recess is formed in at least one of the front cover and the rear cover of the rotating drum to accommodate the balancer, wherein the balancer housing includes a first balancer housing section and a second balancer housing section, which are coupled to each other to define a race therebetween, and wherein the balancer housing is installed in the annular recess of the rotating drum such that the plurality of balls disposed completely within the balancer housing do not establish direct contact with any portion of the rotating drum including the annular recess.

2. The drum type washing machine according to claim 1, wherein the balls are made of iron.

3. The drum type washing machine according to claim 1, wherein the radius (R) of the balancer is 280 millimeters.

4. The drum type washing machine according to claim 1, wherein the total weight of the balls disposed in the housing of the balancer is approximately 300 grams.

5. The drum type washing machine according to claim 1, wherein the balancer housing is installed in the annular recess of the rotating drum so that collision noise generated by the balls, during an operation of the washing machine, is at least partially reduced by a section of the rotating drum forming the annular recess.

* * * * *

UNITED STATES PATENT AND TRADEMARK OFFICE

CERTIFICATE OF CORRECTION

PATENT NO. : 7,861,560 B2
APPLICATION NO. : 11/892926
DATED : January 4, 2011
INVENTOR(S) : Doo Young Ryu et al.

It is certified that error appears in the above-identified patent and that said Letters Patent is hereby corrected as shown below:

Title Page, Item (56) (Other Publications), insert --Korean Office Action dated July 29, 2010 issued in corresponding Korean Patent Application.--.

Column 6, Line 11, In Claim 11, delete "θis" and insert --θ is--, therefor.

Signed and Sealed this
Twenty-sixth Day of April, 2011

David J. Kappos

David J. Kappos
*Director of the United States Patent and Trademark Office*